United States Patent [19]

Takeuchi et al.

[11] Patent Number: 4,469,314

[45] Date of Patent: Sep. 4, 1984

[54] METAL HEATING FURNACE

[75] Inventors: Osamu Takeuchi, Mitaka; Akira Aizawa, Musashino, both of Japan

[73] Assignee: Ishikawajima-Harima Jukogyo Kabushiki Kaisha, Tokyo, Japan

[21] Appl. No.: 323,092

[22] Filed: Nov. 19, 1981

[30] Foreign Application Priority Data

May 21, 1981 [JP] Japan ..... 56-77006

[51] Int. Cl.[3] ..... C21C 9/00

[52] U.S. Cl. ..... 266/252; 432/144; 432/175; 266/274

[58] Field of Search ..... 266/249, 251, 252, 274, 266/111; 432/31, 147, 175

[56] References Cited

U.S. PATENT DOCUMENTS

| | | | |
|---|---|---|---|
| 2,543,708 | 2/1951 | Rice et al. | 266/252 |
| 2,933,425 | 4/1960 | Hess | 148/13 |
| 3,208,740 | 9/1965 | Nosbitt et al. | 432/147 |
| 4,120,646 | 10/1978 | Groff et al. | 432/121 |
| 4,174,097 | 11/1979 | Schwain | 266/87 |
| 4,198,764 | 4/1980 | Ellison et al. | 34/32 |
| 4,373,702 | 2/1983 | Jayaraman et al. | 266/111 |

FOREIGN PATENT DOCUMENTS

| | | | |
|---|---|---|---|
| 2832442 | 2/1979 | Fed. Rep. of Germany | 432/175 |

OTHER PUBLICATIONS

"Transactions of the Iron and Steel Institute of Japan", vol. 17, No. 5, 1977, pp. 290–296, By Matsunaga et al.

"IHI Engineering Review", Special Issue—'70, Jun. 1970, pp. 42–50, by Katahashi et al.

*Primary Examiner*—L. Dewayne Rutledge
*Assistant Examiner*—Christopher W. Brody
*Attorney, Agent, or Firm*—Scrivener Clarke Scrivener & Johnson

[57] ABSTRACT

A metal heating furnace for heating slabs, billets or blooms prior to their hot rolling. Full use to thermal energy can be ensured and the workpieces can be uniformly heated to a desired rolling temperature.

1 Claim, 6 Drawing Figures

METAL HEATING FURNACE

BACKGROUND OF THE INVENTION

The present invention relates to a metal heating furnace. In general, the prior art metal heating furnaces are of the direct-fired type in which burners are used to directly burn fuel. The direct-fired method may be divided into the upper roof burner system and the side burner system, both of which have the following defects:

(i) In the direct-fired method, the heat is transferred from the gaseous heat-radiating body, that is, the flames which are hot gases and are inferior in heat-transfer capability to the solid heat-radiating body. As a result, it is extremely difficult to ensure the uniformity of furnace temperature distribution required.

(ii) Recently, metal heating furnaces have become large in size. With a large metal heating furnace more than 30 meters in length and more than 10 meters in width, the flames even with higher speeds of propagation cannot reach the center portion of the furnace so that the temperature difference between the center portion and the top and side walls of the furnace reaches higher than 100° C., (the center portion being lower in temperature than the top and side walls). If the quantity or rate of combustion is throttled, the energy with which the combustion mixture is blown out through the nozzle is reduced accordingly. As a result, the flame propagation is much disturbed by the turbulent flows of the products of combustion in the furnace so that the temperature difference is further enhanced and subsequently the temperature distribution is much wildly fluctuated.

(iii) Because of the disturbance of the flame propagation, the material is subject to local heating so that the qualities of the material are degraded or the fuel in more quantity than required must be burned, resulting in the losses of energy.

The present invention was made to overcome the above and other problems encountered in the prior art metal heating furnace and has for its object to provide a metal heating furnace which utilizes solid heat-radiating bodies so that the required uniformity of temperature distribution in the furnace can be maintained and energy savings can be attained and which can uniformly heat the materials so that the qualities of heated materials can be improved and at the same time the full utilization of the products of combustion can be ensured.

The present invention will become more apparent from the following description of preferred embodiments thereof taken in conjunction with the accompanying drawings.

BRIEF DESCRIPTION OF THE DRAWINGS

The same reference numerals are used to designate similar parts throughout the figures.

DETAILED DESCRIPTION OF THE PREFERRED EMBODIMENTS FIRST EMBODIMENT, FIGS. 1-3

Figure 1:
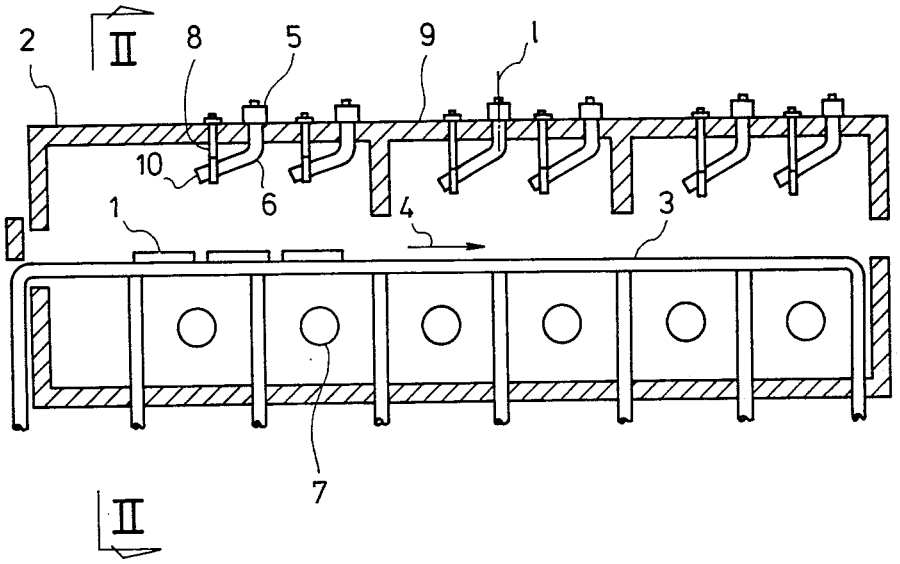
FIG. 1 is a longitudinal sectional view of a first embodiment of a metal heating furnace in accordance with the present invention.
Figure 2:
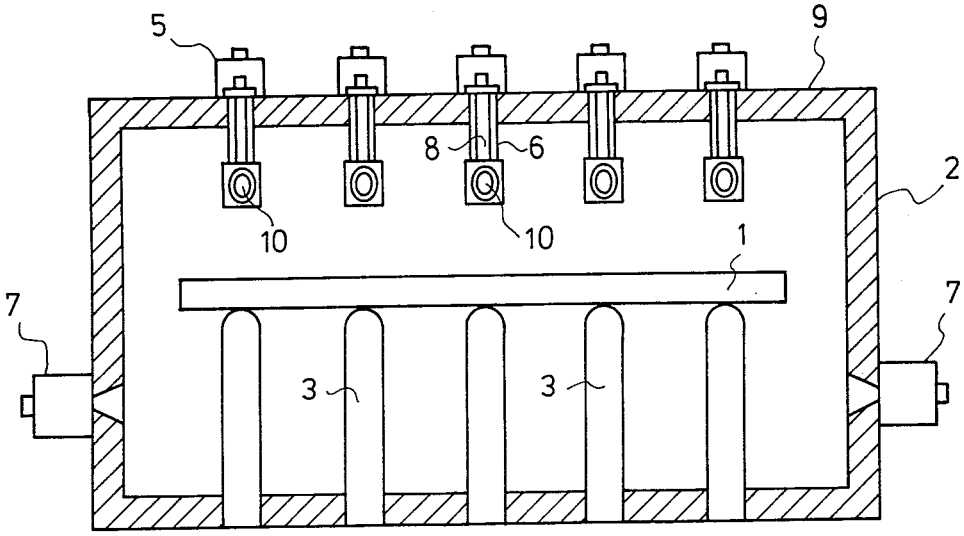
FIG. 2 is a cross sectional view taken along the line II—II of FIG. 1.

Referring to FIGS. 1 and 2, metal materials 1 are moved in a heating furnace 2 in the direction indicated by an arrow 4 by a material support 3. A plurality of axially spaced combustion devices each comprising an overfired burner 5 and a radiant tube 6 extend through a roof 9 of the heating furnace 2. Underfired burners 7 are installed through the side walls of the heating furnace 2 at the positions below the passage of the heated materials 1. Therefore, while the heated materials 1 are continuously moved through the furnace 2, they are heated by the overfired combustion devices and the underfired burners 7.

Figure 3:
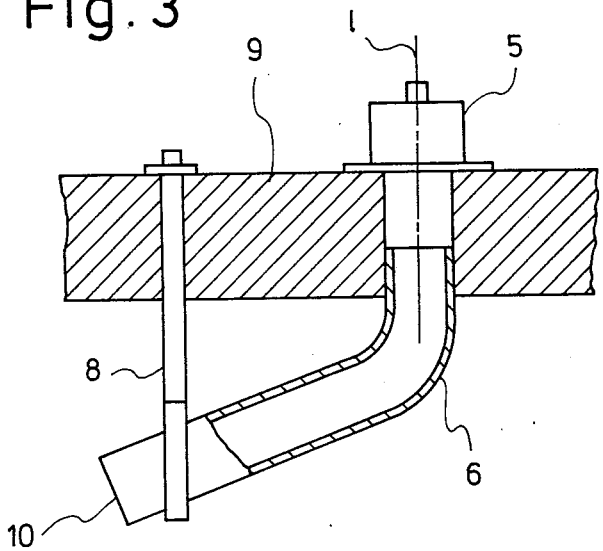
FIG. 3 is a sectional view of a combustion means thereof.

As best shown in FIG. 3, the overfired combustion device comprises the burner 5 and the radiant tube 6 which is bent in such a way that its open end is substantially lined with longitudinal direction as best shown in FIG. 2. The V-shaped radiant tube 6 is supported by a hanger 8 suspended from the roof 9.

As best shown in FIGS. 1 and 3, it is preferable that the angle of the axis of the lower bent portion of the radiant tube 6 which makes with the vertical l be 90° or less than . If required, a straight radiant tube can be inclined through the roof 9 at a suitable angle relative to the vertical l.

As described above, according to the present invention, the overfired combustion device comprises, in combination, the burner 5 and the radiant tube 6. The combustion or air-fuel mixture is charged through the burner 5 and burned in the radiant tube 6 and the flame and the products of combustion are discharged from the open end 10 of the radiant tube 6 into the furnace 2. Therefore, when the flame and the products of combustion pass through the radiant tube 6, they heat the latter and are discharged at predetermined portions of the furnace 2. As a consequence, while the heated materials 1 are moving in the direction 4 by the support 3 through the furnace 2, their upper surfaces are heated by the overfired combustion devices each comprising the burner 5 and the radiant tube 6 as described above and their lower surfaces are heated by the underfired burners 7.

For the heating temperatures lower than 1,000° C., the radiant tubes 6 are preferably made of heat-resisting steel, but for the heating temperatures in excess of 1,000° C., it is preferable that they are made of ceramics such as silicon carbide. The length of the radiant tubes 6 is suitably selected depending upon the size of the heating furnace 2 and the heating conditions.

As shown in FIGS. 1 and 2, the overfired combustion devices each comprising the burner 5 and the radiant tube 6 can be arranged in a matrix array. That is, as best shown in FIG. 2, more than one overhead combustion devices can be arranged or juxtaposed in the widthwise direction and spaced apart from each other by a suitable distance. This means that a large number of small-sized burners can be arranged and consequently even at relatively low heating temperatures, the desired uniformity of temperature distribution in the furnace can be ensured. To put into another way, it becomes easy to maintain the required uniformity of temperature distribution even at relatively low heating temperatures.

SECOND EMBODIMENT, FIGS. 4–6

Figure 6:
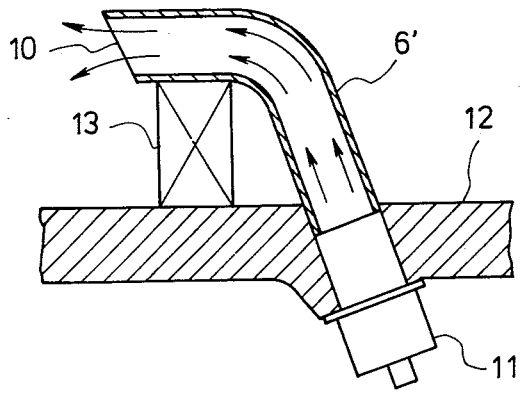
FIG. 6 is a sectional view of a combustion means thereof.
Figure 4:
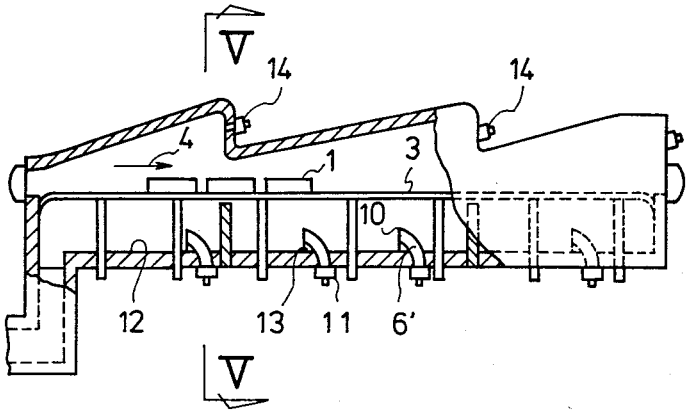
FIG. 4 is a fragmentary longitudinal sectional view of a second embodiment of the present invention.
Figure 5:
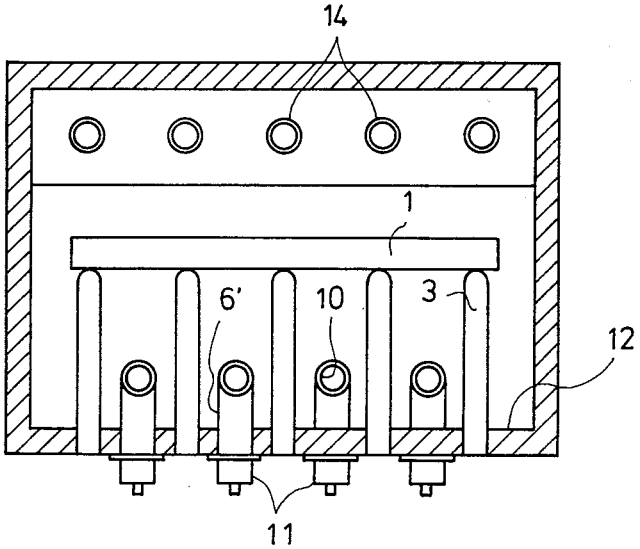
FIG. 5 is a sectional view taken along the line V—V of FIG. 4.

In the second embodiment of the present invention, underfired combustion devices each comprising in combination an underfired burner 11 and a radiant tube 6' extend through the furnace floor 12. As best shown in FIG. 6, the radiant tube 6' is bent in the form of a letter V so that its open end is oriented in the longitudinal direction of the heating furnace 2. Therefore, as in the case of the first embodiment, the flames and the products of combustion can be directed toward desired portions in the furnace 2 below the heated materials 1. The bent portion of the V-shaped radiant tube is supported by a supporting member or block 13 at a position higher than the furnace floor 12 so that damage to the radiant tube due to various substances deposited on the furnace floor 12 can be avoided.

Overfired burners 14 are arranged through the roof of furnace 2.

While the heated materials 1 are moved in the direction indicated by the arrow 4 by the material support 3, their upper portions are heated by the overfired burners 14 and their lower portions are heated by the underfired combustion devices.

As best shown in FIG. 6, the combustion or air-fuel mixture is charged through the burner 11 and burned in the radiant tube 6' so that the flame and the products of combustion are discharged from its open end 10 to predetermined portions in the furnace 2.

The open end 10 of the radiant tube 6' can be beveled at a suitable angle relative to the axis thereof in such a way that the upper portion extends longer in the downstream direction than the lower half portion. Therefore, the intrusion of scales or the like which fall from the heated materials 1 into the radiant tube 6' and then into the burner 11 can be avoided.

The effects and advantages of the present invention may be summarized as follows:

(I) The overfired or underfired combustion devices each comprises the burner and the radiant tube which is so directed that the flame and the products of combustion can be directed in the longitudinal direction of the furnace. The radiant tube serves as a source of reradiation of heat. As a consequence, the uniformity of temperature distribution especially in the longitudinal direction of the furnace can be ensured so that the effective heating of materials can be attained. Since the heating tube serves as the reradiation source as described above, the pitch between the overfired combustion devices can be increased so that the number of overfired burners can be reduced and the initial cost can be loweard accordingly.

(II) The heat is reradiated from the radiant tubes which are the solid heat reradiation sources so that the heat-transfer efficiency can be improved. As a result, it is not needed to burn extra fuel so that energy savings can be attained. Since the materials are uniformly heated, their qualities can be improved.

(III) The radiant tubes have open ends so that the flames and the products of combustion can be directed toward desired portions of the furnace and consequently the heat transfer by convection can be improved. At the same time, effective use of the products of combustion can be attained.

(IV) The number and size such as diameter and length of the radiant tubes can be freely selected so that the best or optimum arrangement of the burners can be attained depending upon the size of the heating furnace and the heating conditions required.

(V) With the overfired radiant tubes, (a) Nose portions which will not contribute to the effective heating of materials can be eliminated.

(b) The furnace roof can be made flat so that the upper structure of the heating furnace can be simplified and consequently easy maintenance can be ensured. As a result, safety can be improved.

(c) The overhead combustion devices are free from demage due to scales or the like falling from the heated materials so that the heating operation will not be adversely affected and carried out very effectively.

(VI) With the underfired radiant tubes, (a) The furnace floor can be made flat and simple in construction so that easy maintenance can be ensured. Furthermore safety can be ensured because the accumulation of heat is reduced.

(b) Unlike the prior art metal heating furnaces, it is not needed to form ridges and valleys on the floor so that the temperature drop of the heated material at such ridges can be avoided.

(c) The flame are guided by the radiant tubes so that they can be prevented from impinging against the material support. Therefore, the burnout of its supporting beams can be reduced to a minimum.

What is claimed is:

1. A metal heating furnace, comprising a chamber having side walls, substantially horizontal roof and floor, end walls, and a substantially horizontal work support extending along the length of the chamber from end wall to end wall between the roof and the floor along which work pieces are moved, and p0 (a) heating means comprising:

(i) a plurality of imperforate open-end radiant heating tubes which are positioned in longitudinally spaced relation along the length of the chamber in vertically spaced relation and longitudinal alignment with the work support, thereby forming a substantially continuous line of radiant heating means vertically spaced with respect to the work support and longitudinally aligned with it, (ii) each of the radiant tubes having an outer end mounted in a horizontal part of the chamber and extending from its outer end at an acute angle to the vertical toward the work support with its open inner end adjacent and directed toward the work support, and (iii) means connected to the outer end of each radiant tube for supplying an air-fuel mixture to the tube for combustion within the tube.

* * * * *

UNITED STATES PATENT AND TRADEMARK OFFICE

CERTIFICATE OF CORRECTION

PATENT NO. : 4,469,314

DATED : September 4, 1984

INVENTOR(S) : Osamu Takeuchi and Akira Aizawa

It is certified that error appears in the above-identified patent and that said Letters Patent are hereby corrected as shown below:

Claim 1, Line 6, delete "p0";

Line 21, delete "and";

Line 24, change period to comma, after comma insert --and--;

After line 24 insert the following:

--(iv). a second heating means on the opposite vertical side of the work support from the radiant tubes and directed inwardly of the chamber.--.

Signed and Sealed this

*Fourteenth* Day of *May 1985*

[SEAL]

*Attest:*

DONALD J. QUIGG

*Attesting Officer* *Acting Commissioner of Patents and Trademarks*